US010595392B2

(12) United States Patent
Pärnaste et al.

(10) Patent No.: US 10,595,392 B2
(45) Date of Patent: Mar. 17, 2020

(54) TARGET ASSEMBLY AND ISOTOPE PRODUCTION SYSTEM HAVING A GRID SECTION

(71) Applicant: General Electric Company, Schenectady, NY (US)

(72) Inventors: Martin Pärnaste, Uppsala (SE); Johan Larsson, Uppsala (SE); Tomas Eriksson, Uppsala (SE)

(73) Assignee: General Electric Company, Schenectady, NY (US)

( * ) Notice: Subject to any disclaimer, the term of this patent is extended or adjusted under 35 U.S.C. 154(b) by 683 days.

(21) Appl. No.: 15/185,923

(22) Filed: Jun. 17, 2016

(65) Prior Publication Data

US 2017/0367170 A1 Dec. 21, 2017

(51) Int. Cl.

| | |
|---|---|
| ***H05H 6/00*** | (2006.01) |
| ***G21G 1/10*** | (2006.01) |
| *G21G 1/00* | (2006.01) |

(52) U.S. Cl.
CPC ..... *H05H 6/00* (2013.01); *G21G 1/10* (2013.01); *G21G 2001/0021* (2013.01)

(58) Field of Classification Search
CPC .. H05H 1/18; H05H 6/00; G21G 1/10; G21G 1/0001; G21G 1/0005; G21H 5/00
USPC ..... 376/112, 190, 202
See application file for complete search history.

(56) References Cited

U.S. PATENT DOCUMENTS

| | | | |
|---|---|---|---|
| 5,917,874 A | 6/1999 | Schlyer et al. | |
| 6,433,495 B1 | 8/2002 | Wiberg | |
| 8,111,801 B2 * | 2/2012 | Hur | H05H 6/00 376/194 |

(Continued)

FOREIGN PATENT DOCUMENTS

| | | |
|---|---|---|
| EP | 2146555 A1 | 1/2010 |
| WO | 97/07122 A2 | 2/1997 |

(Continued)

OTHER PUBLICATIONS

International Search Report and Written Opinion for corresponding PCT application No. PCT/US2016/048579 dated Feb. 2, 2017; 11 pages.

(Continued)

*Primary Examiner* — Jack W Keith
*Assistant Examiner* — Daniel Wasil
(74) *Attorney, Agent, or Firm* — Dean D. Small; The Small Patent Law Group, LLC

(57) ABSTRACT

Target assembly includes a target body having a production chamber and a beam passage. The target body includes first and second grid sections that are disposed in the beam passage. Each of the first and second grid sections has front and back sides. The back side of the first grid section and the front side of the second grid section abut each other with an interface therebetween. The back side of the second grid section faces the production chamber. The target assembly also includes a foil positioned between the first and second grid sections. Each of the first and second grid sections has interior walls that define grid channels through the first and second grid sections. The particle beam is configured to pass through the grid channels toward the production chamber. The interior walls of the first and second grid sections engage opposite sides of the foil.

20 Claims, 8 Drawing Sheets

(56) References Cited

U.S. PATENT DOCUMENTS

| | | | | |
|---|---|---|---|---|
| 8,288,736 | B2 | 10/2012 | Amelia et al. | |
| 2005/0201504 | A1 | 9/2005 | Zeisler et al. | |
| 2006/0291607 | A1 | 12/2006 | Hong et al. | |
| 2009/0090875 | A1 | 4/2009 | Gelbart et al. | |
| 2011/0255646 | A1 | 10/2011 | Eriksson et al. | |
| 2013/0163708 | A1 | 6/2013 | Lambert et al. | |
| 2013/0259180 | A1* | 10/2013 | Norling | H05H 6/00 376/190 |
| 2015/0170777 | A1* | 6/2015 | Hong | G21H 5/00 376/156 |

FOREIGN PATENT DOCUMENTS

| | | | |
|---|---|---|---|
| WO | 2003099374 | A2 | 12/2003 |
| WO | 2007040024 | A1 | 4/2007 |
| WO | 2015/175972 | A2 | 11/2015 |

OTHER PUBLICATIONS

International Atomic Energy Agency; Cyclotron Produced Radionuclides: Operation and Maintenance of Gas and Liquid Targets; IAEA Radioisotopes and Radiopharmaceuticals Series No. 4; 2012; 120 pages.

Bender et al.; Supported Foil Solution for Legacy Helium-Cooled Targets When an Alternative to Havar Foil Materia is Desired; PET Imaging Center, University of Iowa Health Care; 2010; 2 pages.

Stevenson; Universal Methods of Irradiating Target Materials for High Current Accelerator Radioisotope Production; TRIUMF; 1997; 4 pages.

* cited by examiner

TARGET ASSEMBLY AND ISOTOPE PRODUCTION SYSTEM HAVING A GRID SECTION

BACKGROUND

The subject matter disclosed herein relates generally to isotope production systems, and more particularly to isotope production systems having a target material that is irradiated with a particle beam.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles (e.g., H− ions) and directs the beam into a target material to generate the isotopes. The cyclotron is a complex system that uses electrical and magnetic fields to accelerate and guide the charged particles along a predetermined orbit within an acceleration chamber. When the particles reach an outer portion of the orbit, the charged particles form a particle beam that is directed toward a target assembly that holds the target material for isotope production.

The target material, which is typically a liquid, gas, or solid, is contained within a chamber of the target assembly. The target assembly forms a beam passage that receives the particle beam and permits the particle beam to be incident on the target material in the chamber. To contain the target material within the chamber, the beam passage is separated from the chamber by one or more foils. For example, the chamber may be defined by a void within a target body. A target foil covers the void on one side and a section of the target assembly may cover the opposite side of the void to define the chamber therebetween. The particle beam passes through the target foil and deposits a relatively large amount of power within a relatively small volume of the target material, thereby causing a large amount of thermal energy to be generated within the chamber. A portion of this thermal energy is transferred to the target foil.

At least some known systems use two foils that are separated by a cooling chamber. A first foil separates the vacuum in the acceleration chamber of the cyclotron from the cooling chamber and a second foil (or target foil) separates the cooling chamber from the chamber where the target material is located. As described above, the second foil absorbs thermal energy from the chamber. The first foil may also generate thermal energy when the particle beam is incident on the first foil.

It is important to transfer the thermal energy away from the foils. In addition to the elevated temperatures, the foils may experience different pressures. The stress caused by the temperature and different pressures render the foils vulnerable to rupture, melting, or other damage. If the foils are damaged, the level of energy that enters the production chamber increases. Greater energy levels may generate unwanted isotopes or other impurities that render the target material unusable. Accordingly, the lifetime of a foil can be lengthened by reducing the thermal energy in the foil.

To address this challenge, conventional systems include a cooling system that transfers the thermal energy away from the first and second foils. The cooling system directs a cooling medium (e.g., helium) through the cooling chamber that absorbs thermal energy from the foils. This cooling system, however, can be complex, costly, and time-consuming to assemble and operate.

BRIEF DESCRIPTION

In an embodiment, a target assembly for an isotope production system is provided. The target assembly includes a target body having a production chamber and a beam passage. The production chamber is positioned to receive a particle beam directed through the beam passage. The production chamber is configured to hold a target material. The target assembly also includes first and second grid sections of the target body that are disposed in the beam passage. Each of the first and second grid sections has front and back sides. The back side of the first grid section and the front side of the second grid section abut each other with an interface therebetween. The back side of the second grid section faces the production chamber. The target assembly also includes a foil positioned between the first and second grid sections at the interface. Each of the first and second grid sections has interior walls that define grid channels through the first and second grid sections, respectively. The particle beam configured to pass through the grid channels toward the production chamber. The interior walls of the first and second grid sections engage opposite sides of the foil.

In some embodiments, the second grid section has a radial surface that surrounds the beam passage and defines a profile of a portion of the beam passage. The radial surface may be devoid of ports that are fluidically coupled to body channels.

In some embodiments, a cooling channel extends through the target body. The cooling channel is configured to have a cooling medium flow therethrough that absorbs thermal energy from the first and second grid sections and transfer the thermal energy away from the first and second grid sections.

In some embodiments, the foil is a first foil and the target assembly also includes a second foil that engages the back side of the second grid section and faces the production chamber. Optionally, the second foil forming an interior surface that defines the production chamber.

Optionally, the interior walls of the first grid section may engage the first foil and the second foil. In particular embodiments, the first foil is at least 5× thicker than the second foil and/or the first foil is configured to reduce the beam energy of the particle beam by at least 10%. However, it should be understood that the first foil may have a thickness that is less than 5× the thickness of the second foil in other embodiments, and the first foil may be configured to reduce the beam energy of the particle beam by less than 10% in other embodiments.

In an embodiment, an isotope production system is provided that includes a particle accelerator configured to generate a particle beam. The isotope production system includes a target assembly having a production chamber and a beam passage that is aligned with the production chamber. The production chamber is configured to hold a target material. The beam passage is configured to receive a particle beam that is directed toward the production chamber. The target assembly also includes first and second grid sections disposed in the beam passage. Each of the first and second grid sections has front and back sides. The back side of the first grid section and the front side of the second grid section abutting each other with an interface therebetween. The back side of the second grid section faces the production chamber. The isotope production system also includes a foil positioned between the first and second grid sections along the interface. Each of the first and second grid sections have interior walls that define grid channels therebetween. The particle beam is configured to pass through the grid channels toward the production chamber. The interior walls of the first and second grid sections engage the foil.

In an embodiment, a method of generating radioisotopes is provided. The method includes providing a target material into a production chamber of a target assembly. The target assembly has a beam passage that receives the particle beam and permits the particle beam to be incident upon the target material. The target assembly also includes first and second grid sections that are disposed in the beam passage. Each of the first and second grid sections has front and back sides. The back side of the first grid section and the front side of the second grid section abut each other with an interface therebetween. The back side of the second grid section faces the production chamber. The method also includes directing the particle beam onto the target medium. The particle beam passes through a foil that is positioned between the first and second grid sections at the interface. Each of the first and second grid sections has interior walls that define grid channels through the first and second grid sections, respectively. The particle beam is configured to pass through the grid channels toward the production chamber. The interior walls of the first and second grid sections engage opposite sides of the foil.

In some embodiments, the foil is a first foil and the target assembly includes a second foil that engages the back side of the second grid section and faces the production chamber. The particle beam passes through the second foil. Optionally, the method does not include directing a cooling medium between the first and second foils. Optionally, the target material is configured to generate $^{68}$Ga isotopes.

DETAILED DESCRIPTION

Figure 1:
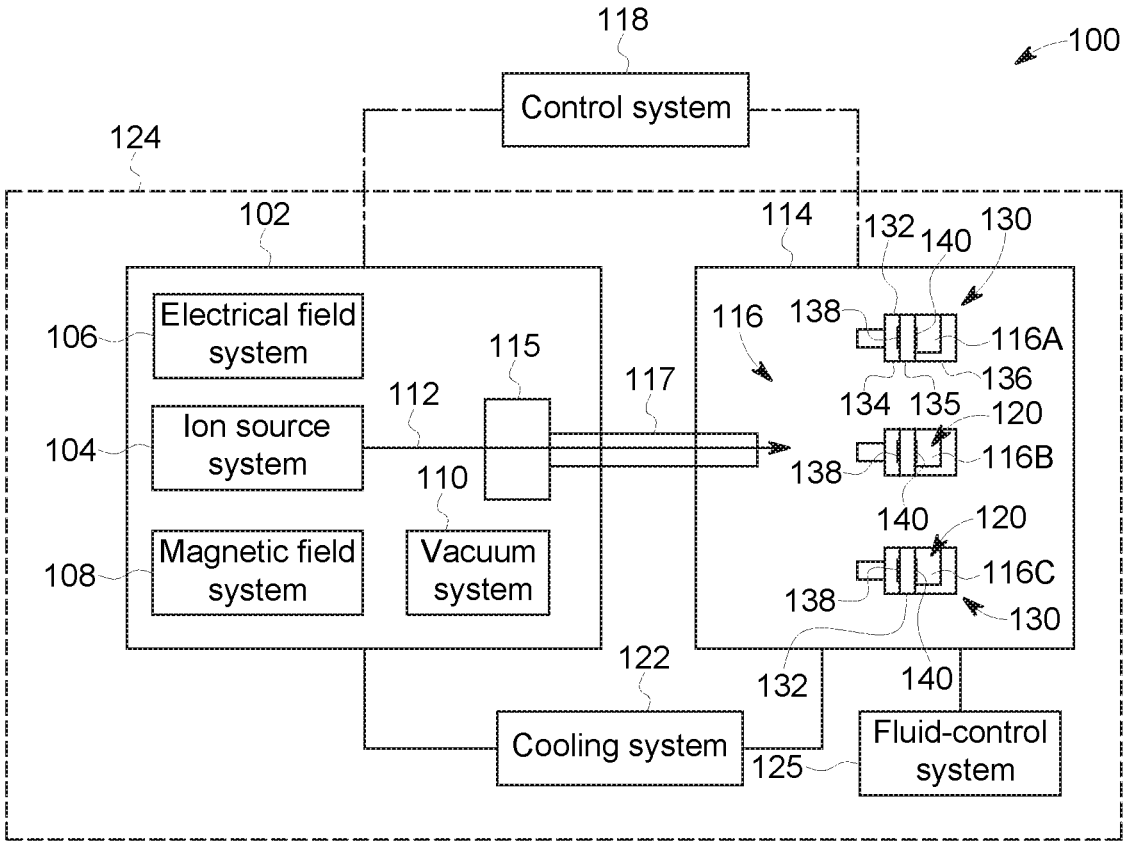
FIG. 1 is a block diagram of an isotope production system in accordance with an embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a block diagram of an isotope production system 100 formed in accordance with an embodiment. The isotope production system 100 includes a particle accelerator 102 (e.g., cyclotron) having several sub-systems including an ion source system 104, an electrical field system 106, a magnetic field system 108, a vacuum system 110, a cooling system 122, and a fluid-control system 125. During use of the isotope production system 100, a target material 116 (e.g., target liquid or target gas) is provided to a designated production chamber 120 of the target system 114. The target material 116 may be provided to the production chamber 120 through the fluid-control system 125. The fluid-control system 125 may control flow of the target material 116 through one or more pumps and valves (not shown) to the production chamber 120. The fluid-control system 125 may also control a pressure that is experienced within the production chamber 120 by providing an inert gas into the production chamber 120.

During operation of the particle accelerator 102, charged particles are placed within or injected into the particle accelerator 102 through the ion source system 104. The magnetic field system 108 and electrical field system 106 generate respective fields that cooperate with one another in producing a particle beam 112 of the charged particles.

Also shown in FIG. 1, the isotope production system 100 has an extraction system 115. The target system 114 may be positioned adjacent to the particle accelerator 102. To generate isotopes, the particle beam 112 is directed by the particle accelerator 102 through the extraction system 115 along a beam path 117 and into the target system 114 so that the particle beam 112 is incident upon the target material 116 located at the designated production chamber 120. It should be noted that in some embodiments the particle accelerator 102 and the target system 114 are not separated by a space or gap (e.g., separated by a distance) and/or are not separate parts. Accordingly, in these embodiments, the particle accelerator 102 and target system 114 may form a single component or part such that the beam path 117 between components or parts is not provided.

The isotope production system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. The isotope production system 100 may produce the isotopes in predetermined amounts or batches, such as individual doses for use in medical imaging or therapy. By way of example, the isotope production system 100 may generate $^{68}$Ga isotopes from a target liquid comprising $^{68}$Zn nitrate in nitric acid. The isotope production system 100 may also be configured to generate protons to make $^{18}F^-$ isotopes in liquid form. The target material used to make these isotopes may be enriched $^{18}O$ water or $^{16}O$-water. In some embodiments, the isotope production system 100 may also generate protons or deuterons in order to produce $^{15}O$ labeled water. Isotopes having different levels of activity may be provided.

In some embodiments, the isotope production system 100 uses $^{1}H-$ technology and brings the charged particles to a low energy (e.g., about 8 MeV or about 14 MeV) with a beam current of approximately 10-30 μA. In such embodiments, the negative hydrogen ions are accelerated and guided through the particle accelerator 102 and into the extraction system 115. The negative hydrogen ions may then hit a stripping foil (not shown in FIG. 1) of the extraction system 115 thereby removing the pair of electrons and making the particle a positive ion, $^{1}H^+$. However, in alternative embodiments, the charged particles may be positive ions, such as $^{1}H^+$, $^{2}H^+$, and $^{3}He^+$. In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV and higher beam currents.

The isotope production system 100 may include a cooling system 122 that transports a cooling fluid (e.g., water or gas, such as helium) to various components of the different systems in order to absorb heat generated by the respective components. For example, one or more cooling channels may extend proximate to the production chambers 120 and absorb thermal energy therefrom. The isotope production system 100 may also include a control system 118 that may be used to control the operation of the various systems and components. The control system 118 may include the necessary circuitry for automatically controlling the isotope production system 100 and/or allowing manual control of certain functions. For example, the control system 118 may include one or more processors or other logic-based circuitry. The control system 118 may include one or more user-interfaces that are located proximate to or remotely from the particle accelerator 102 and the target system 114. Although not shown in FIG. 1, the isotope production system 100 may also include one or more radiation and/or magnetic shields for the particle accelerator 102 and the target system 114.

The isotope production system 100 may be configured to accelerate the charged particles to a predetermined energy level. For example, some embodiments described herein accelerate the charged particles to an energy of approximately 18 MeV or less. In other embodiments, the isotope production system 100 accelerates the charged particles to an energy of approximately 16.5 MeV or less. In particular embodiments, the isotope production system 100 accelerates the charged particles to an energy of approximately 9.6 MeV or less. In more particular embodiments, the isotope production system 100 accelerates the charged particles to an energy of approximately 7.8 MeV or less. However, embodiments describe herein may also have an energy above 18 MeV. For example, embodiments may have an energy above 100 MeV, 500 MeV or more. Likewise, embodiments may utilize various beam current values. By way of example, the beam current may be between about of approximately 10-30 μA. In other embodiments, the beam current may be above 30 μA, above 50 μA, or above 70 μA. Yet in other embodiments, the beam current may be above 100 μA, above 150 μA, or above 200 μA.

The isotope production system 100 may have multiple production chambers 120 where separate target materials 116A-C are located. A shifting device or system (not shown) may be used to shift the production chambers 120 with respect to the particle beam 112 so that the particle beam 112 is incident upon a different target material 116. Alternatively, the particle accelerator 102 and the extraction system 115 may not direct the particle beam 112 along only one path, but may direct the particle beam 112 along a unique path for each different production chamber 120A-C. Furthermore, the beam path 117 may be substantially linear from the particle accelerator 102 to the production chamber 120 or, alternatively, the beam path 117 may curve or turn at one or more points therealong. For example, magnets positioned alongside the beam path 117 may be configured to redirect the particle beam 112 along a different path.

The target system 114 includes a plurality of target assemblies 130, although the target system 114 may include only one target assembly 130 in other embodiments. The target assembly 130 includes a target body 132 having a plurality of body sections 134, 135, 136. The target assembly 130 is also configured to one or more foils through which the particle beam passes before colliding with the target material. For example, the target assembly 130 includes a first foil 138 and a second foil 140. As described in greater detail below, the first foil 138 and the second foil 140 may each engage a grid section (not shown in FIG. 1) of the target assembly 130.

Particular embodiments may be devoid of a direct cooling system for the first and second foils. Conventional target systems direct a cooling medium (e.g., helium) through a space that exists between the first and second foils. The cooling medium contacts the first and second foils and absorbs the thermal energy directly from the first and second foils and transfers the thermal energy away from the first and second foils. Embodiments set forth herein may be devoid of such a cooling system. For example, a radial surface that surrounds this space may be devoid of ports that are fluidically coupled to channels. It should be understood, however, that the cooling system 122 may cool other objects of the target system 114. For instance, the cooling system 122 may direct cooling water through the body section 136 to absorb thermal energy from the production chamber 120. However, it should be understood that embodiments may include ports along the radial surface. Such ports may be used to provide a cooling medium for cooling the first and second foils 138, 140 or for evacuating the space between the first and second foils 138, 140.

Examples of isotope production systems and/or cyclotrons having one or more of the sub-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; 12/435,931 and 14/754,878, each of which is incorporated herein by reference in its entirety.

Figure 2:
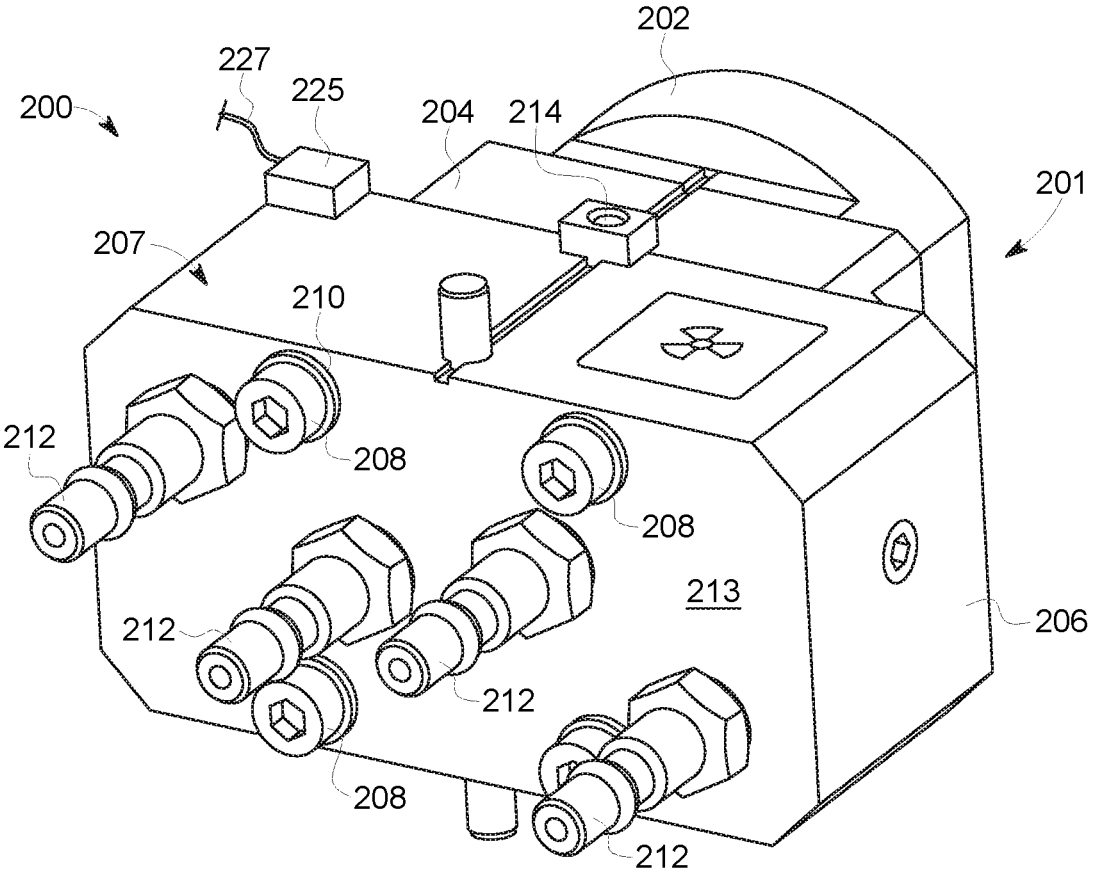
FIG. 2 is a rear perspective view of a target assembly in accordance with an embodiment.
Figure 3:
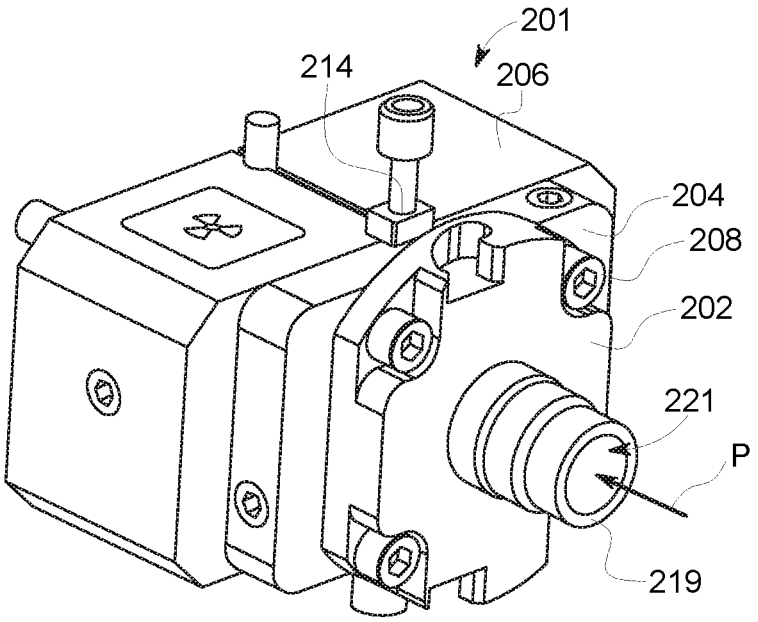
FIG. 3 is front perspective view of the target assembly of FIG. 2.
Figure 4:
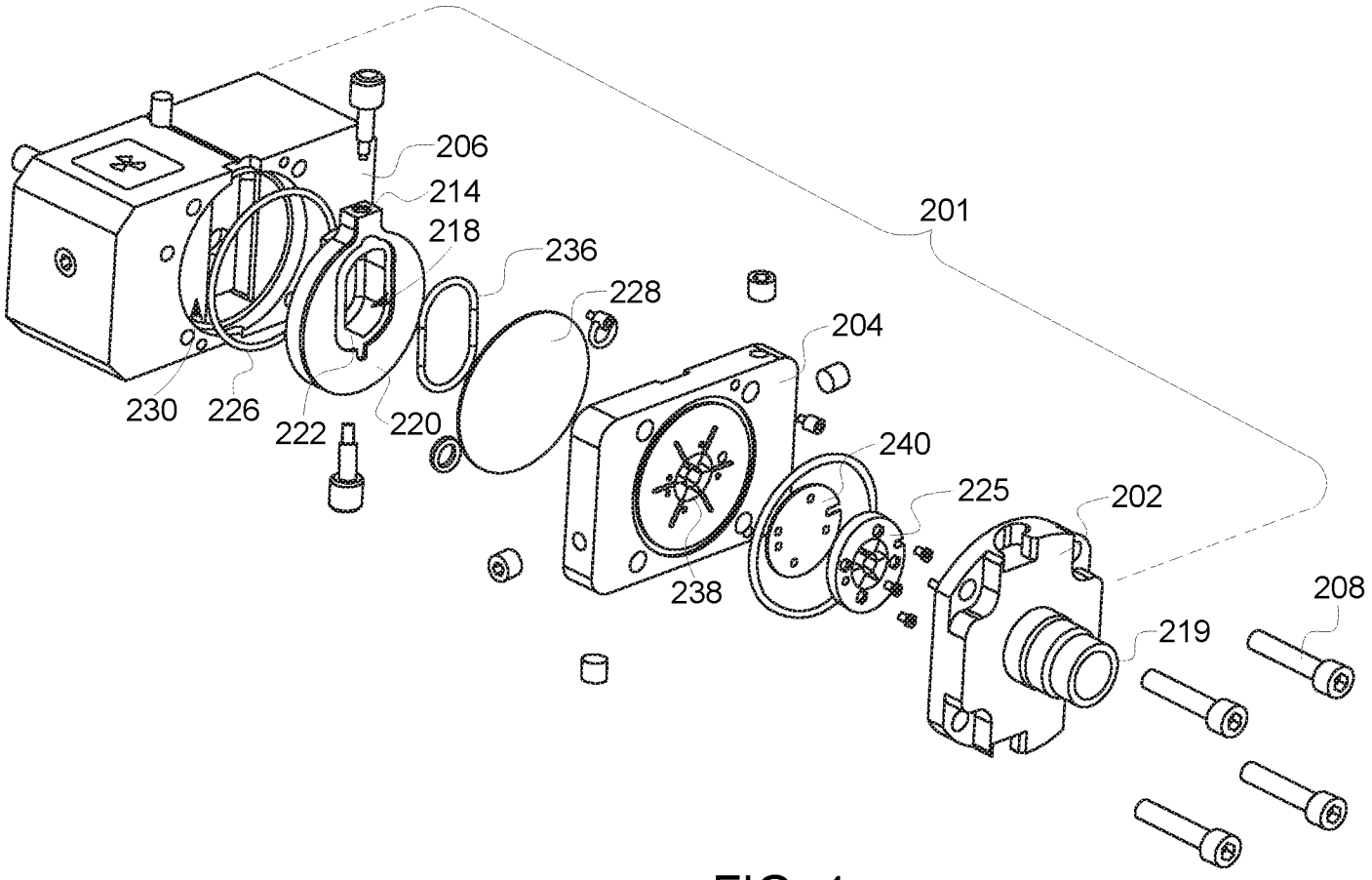
FIG. 4 is an exploded view of the target assembly of FIG. 2.

FIGS. 2 and 3 are rear and front perspective views, respectively, of a target assembly 200 formed in accordance with an embodiment. FIG. 4 is an exploded view of the target assembly 200. The target assembly 200 is configured for use in an isotope production system, such as the isotope production system 100 (FIG. 1). For example, the target assembly 200 may be similar or identical to the target assembly 130 (FIG. 1) of the isotope production system 100.

The target assembly 200 includes a target body 201, which is fully assembled in FIGS. 2 and 3.

The target body 201 is formed from three body sections 202, 204, 206, a target insert 220 (FIG. 4), and a grid section 225 (FIG. 4). The body sections 202, 204, 206 define an outer structure or exterior of the target body 201. In particular, the outer structure of the target body 201 is formed from the body section 202 (which may be referred to as a front body section or flange), the body section 204 (which may be referred to as an intermediate body section) and the body section 206 (which may be referred to as a rear body section). The body sections 202, 204 and 206 include blocks of rigid material having channels and recesses to form various features. The channels and recesses may hold one or more components of the target assembly 200.

The target insert 220 and the grid section 225 (FIG. 4) also include blocks of rigid material having channels and recesses to form various features. The body sections 202, 204, 206, the target insert 220, and the grid section 225 may be secured to one another by suitable fasteners, illustrated as a plurality of bolts 208 (FIGS. 3 and 4) each having a corresponding washer (not shown). When secured to one another, the body sections 202, 204, 206, the target insert 220, and the grid section 225 form a sealed target body 201. The sealed target body 201 is sufficiently constructed to prevent or severely limit leakage of fluids or gas form the target body 201.

As shown in FIG. 2, the target assembly 200 includes a plurality of fittings 212 that are positioned along a rear surface 213. The fittings 212 may operate as ports that provide fluidic access into the target body 201. The fittings 212 are configured to be operatively coupled to a fluid-control system, such as the fluid-control system 125 (FIG. 1). The fittings 212 may provide fluidic access for helium and/or cooling water. In addition to the ports formed by the fittings 212, the target assembly 200 may include a first material port 214 and a second material port 215 (shown in FIG. 6). The first and second material ports 214, 215 are in flow communication with a production chamber 218 (FIG. 4) of the target assembly 200. The first and second material ports 214, 215 are operatively coupled to the fluid-control system. In an exemplary embodiment, the second material port 215 may provide a target material to the production chamber 218, and the first material port 214 may provide a working gas (e.g., inert gas) for controlling the pressure experienced by the target liquid within the production chamber 218. In other embodiments, however, the first material port 214 may provide the target material and the second material port 215 may provide the working gas.

The target body 201 forms a beam passage 221 that permits a particle beam (e.g., proton beam) to be incident on the target material within the production chamber 218. The particle beam (indicated by arrow P in FIG. 3) may enter the target body 201 through a passage opening 219 (FIGS. 3 and 4). The particle beam travels through the target assembly 200 from the passage opening 219 to the production chamber 218 (FIG. 4). During operation, the production chamber 218 is filled with a target liquid or a target gas. For example, the target liquid may be about 2.5 milliliters (ml) of water comprising designated isotopes (e.g., $H_2{}^{18}O$). The production chamber 218 is defined within the target insert 220 that may comprise, for example, a Niobium material having a cavity 222 (FIG. 4) that opens on one side of the target insert 220. The target insert 220 includes the first and second material ports 214, 215. The first and second material ports 214, 215 are configured to receive, for example, fittings or nozzles.

With respect to FIG. 4, the target insert 220 is aligned between the body section 206 and the body section 204. The target assembly 200 may include a sealing ring 226 that is positioned between the body section 206 and the target insert 220. The target assembly 200 also includes a target foil 228 and a sealing border 236 (e.g., a Helicoflex® border). The target foil 228 may be a metal alloy disc comprising, for example, a heat-treatable cobalt base alloy, such as Havar®. The target foil 228 is positioned between the body section 204 and the target insert 220 and covers the cavity 222 thereby enclosing the production chamber 218. The body section 206 also includes a cavity 230 (FIG. 4) that is sized and shaped to receive therein the sealing ring 226 and a portion of the target insert 220.

A front foil 240 of the target assembly 200 may be positioned between the body section 204 and the body section 202. The front foil 240 may be an alloy disc similar to the target foil 228. The front foil 240 aligns with a grid section 238 of the body section 204. The front foil 240 and the target foil 228 may have different functions in the target assembly 228. In some embodiments, the front foil 240 may be referred to as a degrader foil that reduces the energy of the particle beam P. For example, the front foil 240 may reduce the energy of the particle beam by at least 10%. The energy of the particle beam that is incident upon the target material may be about 12 MeV to about 18 MeV. In more particular embodiments, the energy of the particle beam that is incident upon the target material may be about 13 MeV to about 15 MeV. The front foil 240 and the target foil 228 may be referred to, such as in the claims, the first foil and the second foil, respectively.

It should be noted that the target and front foils 228, 240 are not limited to a disc or circular shape and may be provided in different shapes, configurations and arrangements. For example, one or both of the target and front foils 228, 240, or additional foils, may be square shaped, rectangular shaped, or oval shaped, among others. Also, it should be noted that the target and front foils 228, 240 are not limited to being formed from a particular material, but in various embodiments are formed from an activating material, such as a moderately or high activating material that can have radioactivity induced therein as described in more detail herein. In some embodiments, the target and front foils 228, 240 are metallic and formed from one or more metals.

During operation, as the particle beam passes through the target assembly 200 from the body section 202 into the production chamber 218, the target and front foils 228, 240 may be heavily activated (e.g., radioactivity induced therein). The target and front foils 228, 240 isolate a vacuum inside the accelerator chamber from the target material in the cavity 222. The grid section 238 may be disposed between and engage each of the target and front foils 228, 240. Optionally, the target assembly 200 is not configured to permit a cooling medium to pass between the target and front foils 228, 240. It should be noted that the target and front foils 228, 240 are configured to have a thickness that allows a particle beam to pass therethrough. Consequently, the target and front foils 228, 240 may become highly radiated and activated.

Some embodiments provide self-shielding of the target assembly 200 that actively shields the target assembly 200 to shield and/or prevent radiation from the activated target and front foils 228, 240 from leaving the target assembly 200. Thus, the target and front foils 228, 240 are encapsulated by an active radiation shield. Specifically, at least one of, and in some embodiments, all of the body sections 202, 204 and 206 are formed from a material that attenuates the radiation within the target assembly 200, and in particular, from the target and front foils 228, 240. It should be noted that the body sections 202, 204 and 206 may be formed from the same materials, different materials or different quantities or combinations of the same or different materials. For example, body sections 202 and 204 may be formed from the same material, such as aluminum, and the body section 206 may be formed from a combination or aluminum and tungsten.

The body section 202, body section 204 and/or body section 206 are formed such that a thickness of each, particularly between the target and front foils 228, 240 and the outside of the target assembly 200 provides shielding to reduce radiation emitted therefrom. It should be noted that the body section 202, body section 204 and/or body section 206 may be formed from any material having a density value greater than that of aluminum. Also, each of the body section 202, body section 204 and/or body section 206 may be formed from different materials or combinations or materials as described in more detail herein.

Figure 5:
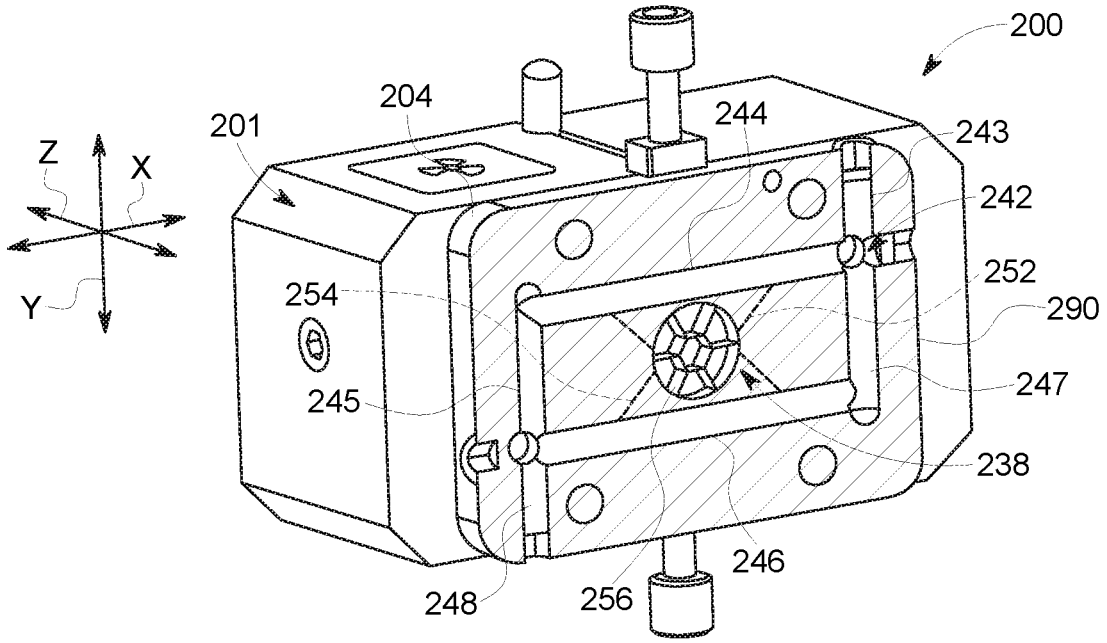
FIG. 5 is a sectional view of the target assembly taken transverse to a Z axis illustrating a cooling channel that absorbs thermal energy of the target assembly.

FIG. 5 is a sectional view of the target assembly 200. For reference, the target assembly 200 is oriented with respect to mutually perpendicular X, Y, and Z axes. The sectional view is made by a plane 290 that is oriented transverse to the Z axis and through the body section 204. In the illustrated embodiment, the body section 204 is an essentially uniform block of material that is shaped to include the grid section 238 and a cooling network 242. For example, the body section 204 may be molded or die-cast to include the physical features described herein. In other embodiments, the body section 204 may comprise two or more elements that are secured to each other. For example, the grid section 238 may be similarly shaped as the grid section 225 (FIG. 4) and be separate and discrete with respect to a remaining portion of the body section 204. In this alternative embodiment, the grid section 238 may be positioned within a void or cavity of the remaining portion.

As shown, the plane 290 through the body section 204 intersects the grid section 238 and the cooling network 242. The cooling network 242 includes cooling channels 243-248 that interconnect with one another to form the cooling network 242. The cooling network 242 also includes ports 249, 250 that are in flow communication with other channels (not shown) of the target body 201. The cooling network 242 is configured to receive a cooling medium (e.g., cooling water) that absorbs thermal energy from the target body 201 and transfers the thermal energy away from the target body 201. For example, the cooling network 242 may be configured to absorb thermal energy from at least one of the grid section 238 or the target chamber 218 (FIG. 4). As shown, the cooling channels 244, 246 extend proximate to the grid section 238 such that respective thermal paths 252, 254 (generally indicated by dashed lines) are formed between the grid section 238 and the cooling channels 244, 246. For example, gaps between the grid section 238 and the cooling channels 244, 246 may be less than 10 mm, less than 8 mm, less than 6 mm, or, in certain embodiments, less than 4 mm. Thermal paths may be identified using, for example, modeling software or thermal imaging during experimental setups.

The grid section 238 includes an arrangement of interior walls 256 that coupled to one another to form a grid or frame structure. The interior walls 256 may be configured to (a) provide sufficient support for the target and front foils 228, 240 (FIG. 4) and (b) intimately engage the target and front foils 228, 240 so that thermal energy may be transferred from the target and front foils 228, 240 to the interior walls 256 and a peripheral region of the grid section 238 or the body section 204.

Figure 6:
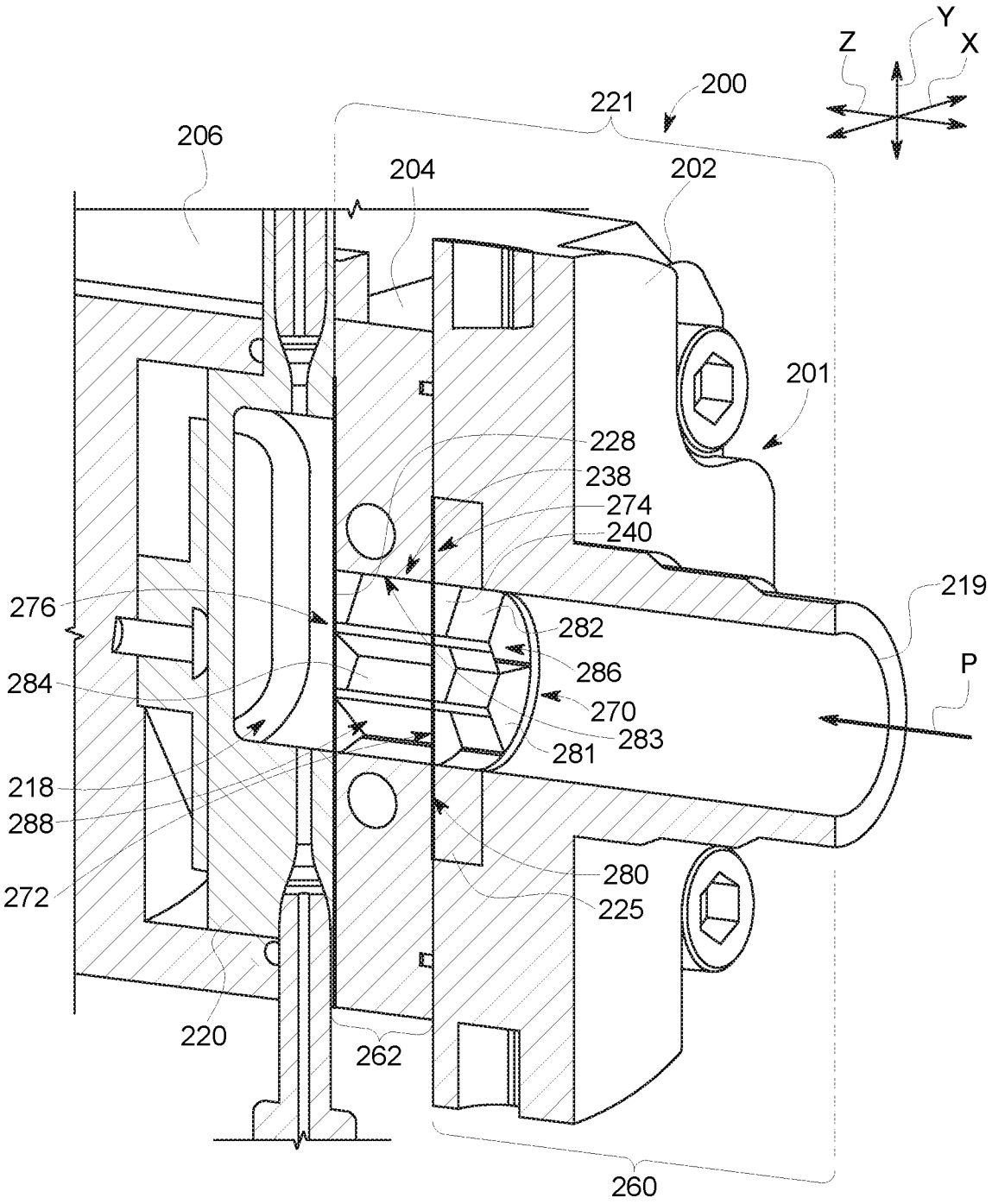
FIG. 6 is a sectional view of the target assembly of FIG. 2 taken transverse to an X axis.
Figure 7:
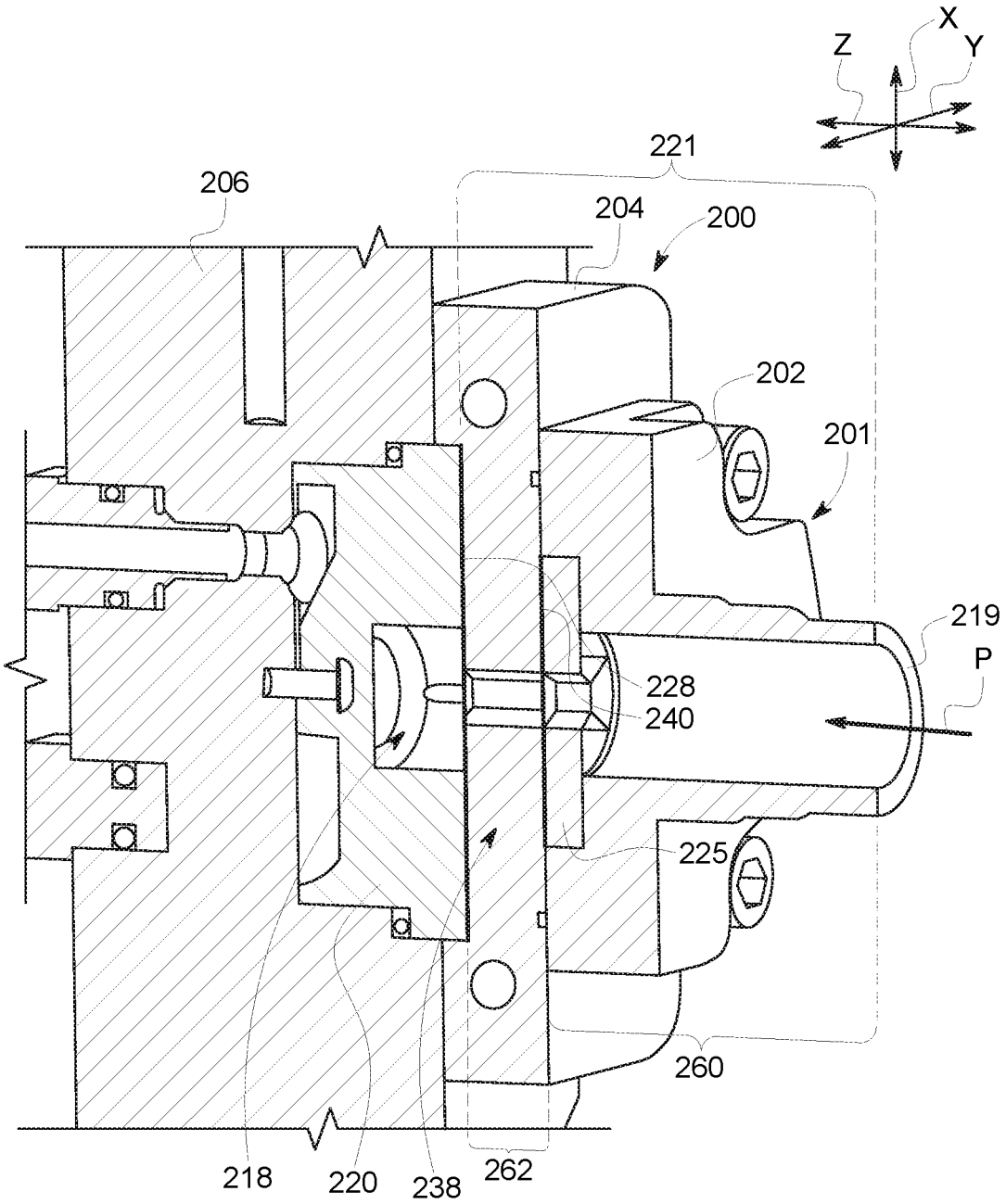
FIG. 7 is a sectional view of the target assembly of FIG. 2 taken transverse to a Y axis.

FIGS. 6 and 7 are sectional views of the target assembly 200 taken transverse to the X and Y axes, respectively. As shown the target assembly 200 is in an operable state in which the body sections 202, 204, 206, the target insert 220, and the grid section 225 are stacked with respect to one another along the Z axis and secured to one another. It should be understood that the target body 201 shown in the figures is one particular example of how a target body may be configured and assembled. Other target body designs that include the operable features (e.g., grid section(s)) are contemplated.

The target body 201 includes a series of cavities or voids through which the particle beam P extends through. For example, the target body 201 includes the production chamber 218 and the beam passage 221. The production chamber 218 is configured to hold a target material (not shown) during operation. The target material may flow into and out of the production chamber 218 through, for example, the first material port 214. The production chamber 218 is positioned to receive the particle beam P that is directed through the beam passage 221. The particle beam P is received from a particle accelerator (not shown), such as the particle accelerator 102 (FIG. 1), which is a cyclotron in the exemplary embodiment.

The beam passage 221 includes a first passage segment (or front passage segment) 260 that extends from the passage opening 219 to the front foil 240. The beam passage 221 also includes a second passage segment (or rear passage segment) 262 that extends between the front foil 240 and the target foil 228. For illustrative purposes, the front foil 240 and the target foil 228 have been thickened for easier identification. The grid section 225 is positioned at an end of the first passage segment 260. The grid section 238 defines an entirety of the second passage segment 262. In the illustrated embodiment, the grid section 238 is an integral part of the body section 204 and the grid section 225 is a separate and discrete element that is sandwiched between the body section 202 and the body section 204.

Accordingly, the grid sections 225, 238 of the target body 201 are disposed in the beam passage 221. As shown in FIG. 6, the grid section 225 has a front side 270 and a back side 272. The grid section 238 also has a front side 274 and a back side 276. The back side 272 of the grid section 225 and the front side 274 of the grid section 238 abut each other with an interface 280 therebetween. The back side 276 of the grid section 238 faces the production chamber 218. In the illustrated embodiment, the back side 276 of the grid section 238 engages the target foil 228. The front foil 240 is positioned between the grid sections 225, 238 at the interface 280.

Also shown in FIG. 6, the grid section 225 has a radial surface 281 that surrounds the beam passage 221 and defines a profile of a portion of the beam passage 221. The profile extends parallel to a plane defined by the X and Y axes. The grid section 238 has a radial surface 283 that surrounds the beam passage 221 and defines a profile of a portion of the beam passage 221. The profile extends parallel to a plane defined by the X and Y axes. In the illustrated embodiment, the radial surface 283 is devoid of ports that are fluidically coupled to channels of the target body. More specifically, the second passage segment 262 may not have forced fluid pumped therethrough for cooling the target and front foils 228, 240 in some embodiments. In alternative embodiments, however, a cooling medium may be pumped therethrough. Yet in other embodiments, ports may be used to evacuate the second passage segment 262.

The grid sections 225, 238 have respective interior walls 282, 284 that define grid channels 286, 288 therethrough. The interior walls 282, 284 of the grid sections 225, 238, respectively, engage opposite sides of the front foil 240. The interior walls 284 of the grid section 238 engage the target foil 228 and the front foil 240. The interior walls 282 of the grid section 225 only engage the front foil 240. The front and target foils 240, 228 are oriented transverse to a beam path of the particle beam P. The particle beam P is configured to pass through the grid channels 286, 288 toward the production chamber 218.

In some embodiments, the grid structure formed by the interior walls 282 and the grid structure formed by the interior walls 284 are identical such that the grid channels 286, 288 align with one another. However, embodiments are not required to have identical grid structures. For example, the grid section 225 may not include one or more of the interior walls 282 and/or one or more of the interior walls 282 may not be aligned with corresponding interior walls 284 or vice versa. Moreover, it is contemplated that the interior walls 282 and the interior walls 284 may have different dimensions in other embodiments.

In some embodiments, the front foil 240 is configured to substantially reduce the energy level of the particle beam P when the particle beam P is incident on the front foil 240. More specifically, the particle beam P may have a first energy level in the first passage segment 260 and a second energy level in the second passage segment 262 in which the second energy level is substantially less than the first energy level. For example, the second energy level may be more than 5% less than the first energy level (or 95% or less of the first energy level). In certain embodiments, the second energy level may be more than 10% less than the first energy level (or 90% or less of the first energy level). Yet in more particular embodiments, the second energy level may be more than 15% less than the first energy level (or 85% or less of the first energy level). Yet in more particular embodiments, the second energy level may be more than 20% less than the first energy level (or 80% or less of the first energy level). By way of example, the first energy level may be about 18 MeV, and the second energy level may be about 14 MeV. It should be understood, however, that the first energy level may have different values in other embodiments and the second energy level may have different values in other embodiments.

In such embodiments in which the front foil 240 substantially reduces the energy level of the particle beam P, the front foil 240 may be characterized as a degrader foil. The degrader foil 240 may have a thickness and/or composition that creates substantial losses as the particle beam P passes through the front foil 240. For example, the front foil 240 and the target foil 228 may have different compositions and/or thicknesses. The front foil 240 may comprise aluminum, and the target foil 228 may comprise Havar® or Niobium, although other materials are contemplated for the foils.

In particular embodiments, the front foil 240 and the target foil 228 have substantially different thicknesses. For example, a thickness of the front foil 240 may be at least 0.10 millimeters (mm). In particular embodiments, the front foil 240 has a thickness that is between 0.15 mm and 0.50 mm. With respect to the target foil 228, a thickness of the target foil 228 may be between 0.01 mm and 0.05 mm. In particular embodiments, a thickness of the target foil 228 may be between 0.02 mm and 0.03 mm. In some embodiments, the front foil 240 is at least three times (3×) thicker than the target foil 228 or at least five times (5×) thicker than the target foil 228. However, the front foil 240 may have other thicknesses, such as being less than 5× or less than 3× thicker than the target foil 228.

Although the front foil 240 may be characterized as a degrader foil in some embodiments, the front foil 240 may not be a degrader foil in other embodiments. For instance, the front foil 240 may not substantially reduce or only nominally reduce the energy level of the particle beam P. In such instances, the front foil 240 may have characteristics (e.g., thickness and/or composition) that are similar to characteristics of the target foil 228.

The losses in the front foil 240 correspond to thermal energy that is generated within the front foil 240. The thermal energy generated within the front foil 240 may be absorbed by the body section 204, including the grid section 238, and conveyed to the cooling network 242 where the thermal energy is transferred from the target body 201.

Although some thermal energy may be generated within the target foil 228 when the particle beam is incident thereon, a majority of the thermal energy from the target foil 228 may be generated within the production chamber 218 when the particle beam P is incident on the target material. The production chamber 218 is defined by an interior surface 266 of the target insert 220 and the target foil 228. As the particle beam P collides with the target material, thermal energy is generated. This thermal energy may be conveyed or transferred through the target foil 228, into the body section 204, and absorbed by the cooling medium flowing through the cooling network 242.

During operation of the target assembly 200, the different cavities may experience different pressures. For example, as the particle beam P is incident upon the target material, the first passage segment 260 may have a first operating pressure, the second passage segment may 262 may have a second operating pressure, and the production chamber 218 may have a third operating pressure. The first passage segment 262 is in flow communication with the particle accelerator, which may be evacuated. Due to the thermal energy and bubbles generated within the production chamber 218, the third operating pressure may be significantly large. In the illustrated embodiment, the second operating pressure may be a function of the operating temperature of the grid section 238. Thus, the first operating pressure may be less than the second operating pressure and the second operating pressure may be less than the third operating pressure.

The grid sections 225, 238 are configured to intimately engage opposite sides of the front foil 240. In addition, the interior walls 282 may prevent the pressure differential between the second passage segment 262 and the first passage segment 260 from moving the front foil 240 away from the interior walls 284. The interior walls 284 may prevent the pressure differential between the production chamber 218 and the second passage segment 262 from moving the target foil 228 into the second passage segment 262. The larger pressure in the production chamber 218 forces the target foil 228 against the interior walls 284. Accordingly, the interior walls 284 may intimately engage the front foil 240 and the target foil 228 and absorb thermal energy therefrom. Also show in FIGS. 6 and 7, the surrounding body section 204 may also intimately engage the front foil 240 and the target foil 228 and absorb thermal energy therefrom.

In particular embodiments, the target assembly 200 is configured to generate isotopes that are disposed within a liquid that may be harmful to the particle accelerator. For example, the starting material for generating $^{68}$Ga isotopes may include a highly acidic solution. To impede the flow of this solution, the front foil 240 may entirely cover the beam passage 221 such that the first passage segment 260 and the second passage segment 262 are not in flow communication. In this manner, unwanted acidic material may not inadvertently flow from the production chamber 218, through the second and first passage segments 262, 260, and into the particle accelerator. To decrease this likelihood, the front foil 240 may be more resistant to rupture. For instance, the front foil 240 may comprise a material having a greater structural integrity (e.g., aluminum) and a thickness that reduces the likelihood of rupture.

In other embodiments, the target assembly 200 is devoid of the target foil 228, but includes the front foil 240. In such embodiments, the grid section 238 may form a part of the production chamber. For example, the target material may be a gas and be located within a production chamber that is defined between the front foil 240 and cavity 222. The grid section 238 may be disposed in the production chamber. In such embodiments, only a single foil (e.g., the front foil 240) is used during production and the single foil is held between the two grid sections 225, 238.

Figure 8:
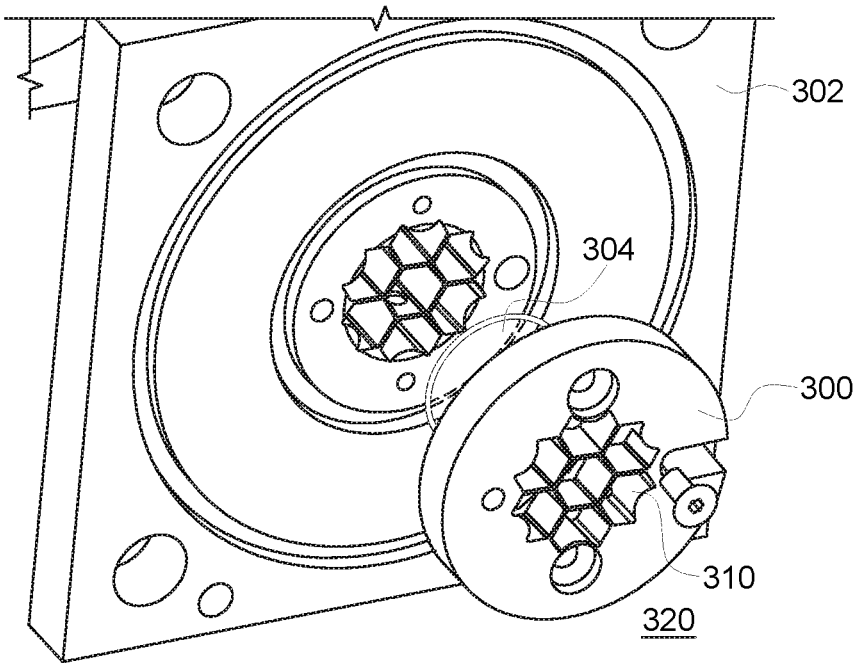
FIG. 8 is a perspective view of first and second grid sections in accordance with an embodiment.
Figure 9:
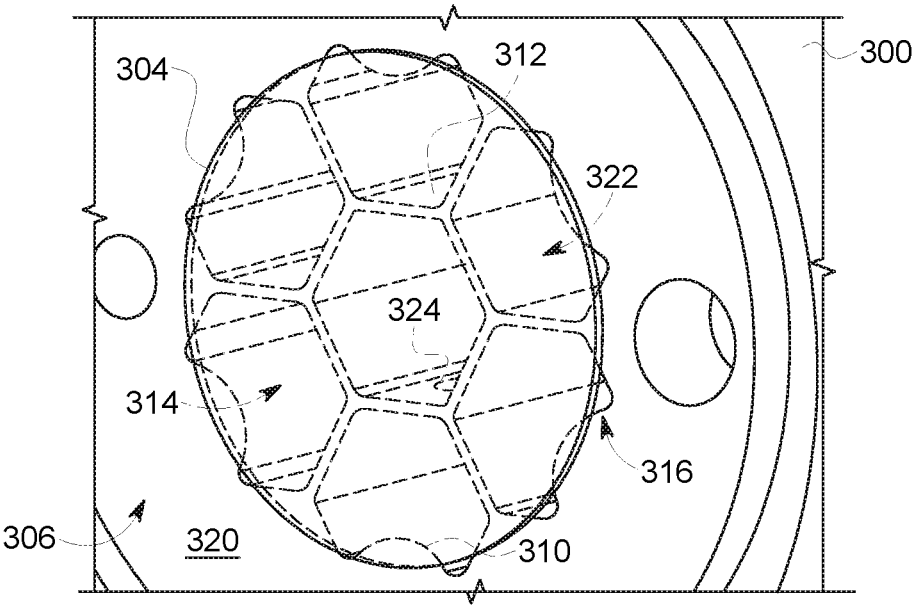
FIG. 9 is an enlarged view of a foil positioned against a front side of the second grid section of FIG. 8.

FIG. 8 illustrates a perspective view of a grid section 300 and a grid section 302 that may be similar to the grid sections 225, 238 (FIG. 4), respectively, and form a part of a target assembly, such as the target assemblies 130, 200 (FIGS. 1 and 3, respectively). FIG. 9 is an enlarged view of a foil 304 positioned against a front side 306 of the grid section 300. In other embodiments, a second passage segment 322 may be in flow communication with a first passage segment 320. The second passage segment 322 is defined by the grid section 300, the foil 304, and another foil (not shown) that may separate the second passage segment 322 and a production chamber (not shown). The first passage segment 320 may be positioned in front of the foil 304 and defined by a body section (not shown) of the target assembly.

With respect to FIG. 9, the grid section 300 includes a radial surface 310 and interior walls 312 that form a grid structure. The radial surface 310 and the interior walls 312 are shaped to form grid channels 314. The grid channels 314 may be sized and shaped relative to a profile or footprint of the foil 304 such that flow gaps 316 exist. More specifically, the grid channels 314 may clear an outer diameter of the foil 304. The flow gaps 316 may fluidly couple the second passage segment 322 and the first passage segment 320. To fluidly couple the central grid channel 314, an aperture 324 may be formed through at least one of the interior walls 312 that define the central grid channel 314.

Figure 10:
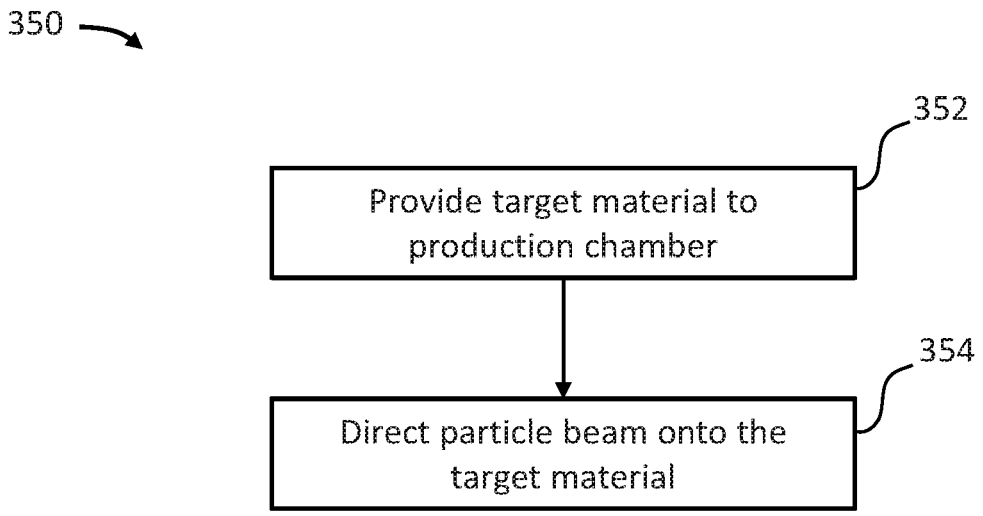
FIG. 10 is a block diagram that illustrates a method of generating radioisotopes.

FIG. 10 illustrates a method 350 of generating radioisotopes. The method includes providing, at 352, a target material into a production chamber of a target body or target assembly, such as the target body 201 or the target assembly 200. In some embodiments, the target material is an acidic solution. In particular embodiments, the target material is configured to generate $^{68}$Ga isotopes. The target body has a beam passage that receives the particle beam and permits the particle beam to be incident upon the target material. The target body also includes first and second grid sections, such as the grid sections 238, 225, respectively. The first and second grid sections are disposed in the beam passage. Each of the first and second grid sections has front and back sides. The back side of the first grid section and the front side of the second grid section abut each other with an interface therebetween. The back side of the second grid section faces the production chamber.

The method also includes directing, at 354, the particle beam onto the target material. The particle beam passes through a foil that is positioned between the first and second grid sections at the interface. Each of the first and second grid sections has interior walls that define grid channels through the first and second grid sections, respectively. The particle beam is configured to pass through the grid channels toward the production chambers. The interior walls of the first and second grid sections engage opposite sides of the foil. Optionally, the foil is a first foil and the target body includes a second foil that engages the back side of the second grid section and faces the production chamber. The particle beam passes through the second foil. Optionally, the method does not include directing a cooling medium between the first and second foils.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand-alone programs, may be incorporated as subroutines in an operating system, may be functions in an installed software package, or the like. The various embodiments are not limited to the arrangements and instrumentality shown in the drawings.

What is claimed is:

1. A target assembly for an isotope production system, the target assembly comprising:

a target body having a production chamber and a beam passage, the production chamber being positioned to receive a particle beam directed through the beam passage, the production chamber configured to hold a target material;

a first grid section and a second grid section of the target body disposed in the beam passage, each of the first and second grid sections having a front side and a back side, the back side of the first grid section and the front side of the second grid section abutting each other with an interface therebetween, the back side of the second grid section facing the production chamber; and a foil positioned between the first and second grid sections at the interface, each of the first and second grid sections having interior walls disposed within the beam passage, at least some of the interior walls of the first grid section extend radially inward in the beam passage, the interior walls defining multiple grid channels through each of the first and second grid sections, respectively, the particle beam configured to pass through the grid channels of the first and second grid sections toward the production chamber, the interior walls of the first and second grid sections engaging opposite sides of the foil.

2. The target assembly of claim 1, wherein the second grid section has a radial surface that surrounds the beam passage and defines a profile of a portion of the beam passage, the radial surface being devoid of ports that are fluidically coupled to cooling channels of the target body.

3. The target assembly of claim 1, further comprising a cooling channel extending through the target body, the cooling channel configured to have a cooling medium flow therethrough that absorbs thermal energy from the second grid section and transfers the thermal energy away from the second grid section.

4. The target assembly of claim 1, wherein the foil is a first foil and the target assembly comprises a second foil that engages the back side of the second grid section and faces the production chamber.

5. The target assembly of claim 4, wherein the second foil forming a chamber wall that defines the production chamber.

6. The target assembly of claim 4, wherein the interior walls of the second grid section engage the first foil and the second foil.

7. The target assembly of claim 4, wherein the first foil is at least 5× thicker than the second foil.

8. The target assembly of claim 4, wherein the first foil is configured to reduce the beam energy of the particle beam by at least 10%.

9. The target assembly of claim 1, wherein interior walls extend across the beam passage.

10. The target assembly of claim 1, wherein the first grid section has a radial surface that surrounds the portion of the beam passage defined by the first grid section and at least some of the interior walls of the first grid section are connected to the radial surface and extend from the radial surface into the beam passage.

11. The target assembly of claim 1, wherein each grid channel of the first grid section is formed by a plurality of the interior walls of the first grid section, and each grid channel of the second grid section is formed by a plurality of the interior walls of the second grid section.

12. The target assembly of claim 1, wherein the grid channels of the first grid section are aligned with corresponding grid channels of the second grid section to define multiple flow paths through the beam passage, wherein the foil extends across and interrupts the flow paths.

13. An isotope production system comprising:

a particle accelerator configured to generate a particle beam; and a target assembly having a production chamber and a beam passage that is aligned with the production chamber, the production chamber configured to hold a target material, the beam passage configured to receive a particle beam that is directed toward the production chamber, the target assembly also including:

a first grid section and a second grid section disposed in the beam passage, each of the first and second grid sections having a front side and a back side, the back side of the first grid section and the front side of the second grid section abutting each other with an interface therebetween, the back side of the second grid section facing the production chamber; and a foil positioned between the first and second grid sections along the interface, each of the first and second grid sections having interior walls disposed within the beam passage, inward in the beam passage, the interior walls defining multiple grid channels through each of the first and second grid sections, the particle beam configured to pass through the grid channels of the first and second grid sections toward the production chamber, the interior walls of the first and second grid sections engaging the foil.

14. The isotope production system of claim 13, wherein the second grid section has a radial surface that surrounds the beam passage and defines a profile of a portion of the beam passage, the radial surface being devoid of ports that are fluidically coupled to cooling channels of the target assembly.

15. The isotope production system of claim 13, further comprising a cooling channel extending through the target body, the cooling channel configured to have a cooling medium flow therethrough that absorbs thermal energy from the first and second grid sections and transfers the thermal energy away from the first and second grid sections.

16. The isotope production system of claim 13, wherein the foil is a first foil and the target assembly comprises a second foil that engages the back side of the second grid section and faces the production chamber.

17. The isotope production system of claim 16, wherein the second foil forms an interior surface that defines the production chamber.

18. The isotope production system of claim 16, wherein the interior walls of the second grid section engage the first foil and the second foil.

19. The isotope production system of claim 16, wherein the first foil is at least 5× thicker than the second foil.

20. The isotope production system of claim 16, wherein the first foil is configured to reduce the beam energy of the particle beam by at least 10%.

* * * * *